United States Patent [19]

Weber

[11] 4,240,649

[45] Dec. 23, 1980

[54] METER CARD PARKING SYSTEM

[76] Inventor: Herb Weber, 12 Copper Beech Pl., Merrick, N.Y. 11566

[21] Appl. No.: 943,129

[22] Filed: Sep. 18, 1978

[51] Int. Cl.[3] ..... B42D 15/00

[52] U.S. Cl. ..... 283/13; 40/333; 283/6; 283/8 A; 283/23

[58] Field of Search ..... 283/9 R, 13, 23, 48 R, 283/66, 6, 8 A; 40/333

[56] References Cited

U.S. PATENT DOCUMENTS

| | | | |
|---|---|---|---|
| 513,151 | 1/1894 | Shattuc | 283/23 |
| 2,839,854 | 6/1958 | Martinet | 283/23 X |
| 2,961,777 | 11/1960 | Neville et al. | 283/9 R |
| 3,528,186 | 9/1970 | Roda | 283/23 X |
| 3,966,232 | 6/1976 | Doriel | 283/23 |
| 4,095,824 | 6/1978 | Bachman | 283/6 |

FOREIGN PATENT DOCUMENTS

| | | | |
|---|---|---|---|
| 2117793 | 10/1972 | Fed. Rep. of Germany | 283/6 |
| 1413918 | 9/1965 | France | 283/23 |
| 379818 | 8/1964 | Switzerland | 283/23 |
| 496386 | 11/1938 | United Kingdom | 283/66 R |

OTHER PUBLICATIONS

Oxydal Advertisement, May, 1965.

*Primary Examiner*—Paul A. Bell
*Attorney, Agent, or Firm*—Larson, Taylor and Hinds

[57] ABSTRACT

A vehicle parking ticket is provided comprising month, day and hour indicia on the face of the card, along with three-layered laminated sections adjacent to the indicia. Use of the cards entails the irreversible destruction of the upper two layers of laminate causing exposure of a readily indentifiable lower layer, thereby preventing counterfeiting and reuse of the ticket.

4 Claims, 3 Drawing Figures

METER CARD PARKING SYSTEM

FIELD OF THE INVENTION

The present invention relates to a vehicle parking ticket, to be used in place of a parking meter system.

BACKGROUND OF THE INVENTION

Mechanical parking meters were originally thought to be a satisfactory means of regulating the flow of traffic in busy urban areas as well as providing much needed revenue to these communities. However, in actual practice, it has been found that many of these parking meters have not lived up to their expectations because of a high incidence of vandalism. Further problems have arisen through the use of counterfeit tokens and coins, plus a constant need for checking and repair. Thus, it has often been found that the high cost of maintaining the mechanical meters has totally negated the purpose for which they were originally intended to be used. As a result, many communities today are allowing the parking meter system to deteriorate through attrition so that it no longer adequately controls the flow of traffic.

Various parking ticket systems have been proposed, such as those described in U.S. Pat. Nos. 2,839,854, 3,528,186 and 3,966,232, to be used in place of parking meter systems. The cards used in these systems are relatively inconvenient to use in that they require writing on or tearing off various portions of the card. A more important problem occurs in the prevention of counterfeiting and reuse of these cards. Supposedly non-readable torn off sections may be repatched on, and slow fading inks enable uncontrollable abuse of the system.

SUMMARY OF THE INVENTION

In accordance with the invention, a specially designed and manufactured ticket or card is provided that could totally eliminate the need for mechanical parking meters that are currently in use on the streets of various cities and municipalities. The ticket comprises a card bearing month, day and hour indicia on the face thereof, and contains three-layered, laminated sections adjacent to the indicia. The three-layers comprise (1) a base layer containing the card face and bearing highlighting or readily identifiable means printed thereon such as a sharply contrasting color, (2) a coating material which is easily destroyed by abrasion, and (3) a design layer printed on the coating material.

The use of the ticket is achieved by scraping the coating material and design layer off, using a coin or like article, thereby exposing the highlighted base layer. The abrasive scraping results in the irreversable destruction of the coating and design layers.

This system thereby offers several advantages in the ease with which the user establishes the time on the card, and most importantly the easiness of validating the exposed time on the ticket by the local authorities. Furthermore, because of the design of the manufacture of the ticket, unlawful duplication is virtually impossible.

Distribution of the vehicle parking tickets could be accomplished by municipalities. The parking tickets could be offered in single or bulk lots and could be distributed through a network of vendors as required by local governments. The system would eliminate the need for any capital investment that is required to indicate or maintain a mechanical parking meter system. It provides for immediate changes in established parking rates merely by changing the value of the ticket. It would totally eliminate any losses through vandalism, and permits for widening of many metered areas to encompass areas which were thought to be impractical for metered parking.

According to the preferred embodiments thereof, the coating layer may be a latex based metallic ink or comparable material. The design or base layers, or both, may include various indicating means for the adjacent indicia sections, such as an arrow pointing to the appropriate corresponding section. The base layer may present a highlighted face or contrasting color or design with the rest of the ticket.

Other features and advantages of the invention will be set forth in, or apparent from, the detailed description of the preferred embodiments found hereinbelow.

DESCRIPTION OF THE PREFERRED EMBODIMENTS

Figure 1:
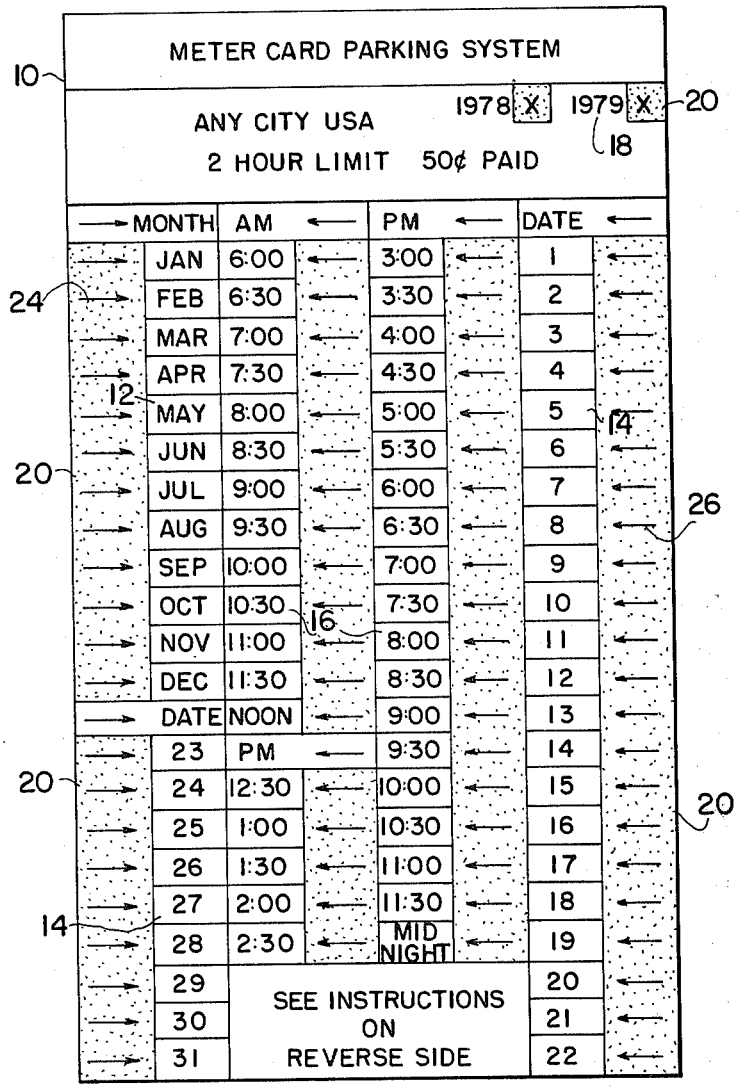
FIG. 1 is a front elevation view of the face of a vehicle parking ticket in accordance with one embodiment of the invention, prior to use.

Referring to FIG. 1, a vehicle parking ticket 10 in shown having month 12, date 14 and hour 16 indicia on its face. Year indicia 18 may also be provided if desired. Adjacent to these indicia are three-layered laminate sections 20 comprising (1) a base layer 22, as shown in FIG. 2, of highlighting means printed onto the card face, (2) a coating material 24 which is easily destroyed by abrasion, and (3) a design layer 26 printed on the coating material.

The design layer 26 may be in the form of an arrow, as shown in the drawings, or in a more intricate design. The presence of the design further inhibits any counterfeiting or additional use of the ticket, since even if additional coating material was reinstated, the design pattern or mark would still be absent. Furthermore, the coating material 24 may be composed of a special glass material or may be specially processed during the coating step, such that substituted coating would be immediately discernable from the original coating. Other design and construction parameters could be contemplated, such that destructive removal of the laminate material creates an irreversable modification of the ticket.

When an arrow is used as the design layer, the user is given a guide as to exactly where abrasion is required to scrape away the coating material 24, such as a latex based metallic ink, to reveal the base layer 22. Any composition of coating material is contemplated, which can be easily scraped off by a coin or any rounded flat object.

Figure 2:
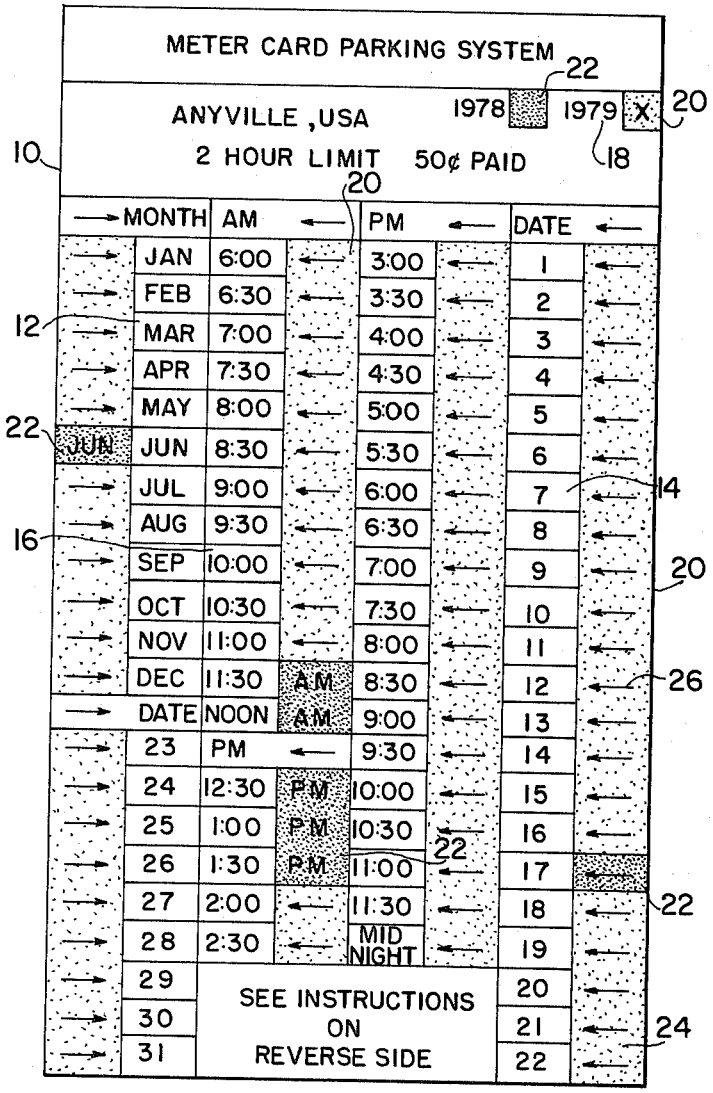
FIG. 2 is a front elevation view of the embodiment in FIG. 1, as it might appear during use.

FIG. 2 shows the face of a vehicle parking ticket 10 while in use. The coating material 24 has been scraped off to reveal the base layer 22 at various portions of the laminated sections 20. The time period set up can be easily read, which in the drawing depicts the two hour period from 11:30 AM to 1:30 PM, on June 17, 1978.

The base layer 22 may have various indicia on it, such as an arrow or design, or may simply be a restatement of the adjacent indicia. In the latter case, it is therefore contemplated that the indicia and laminated sections of the face could be identical, The base layer 22 preferably has a highlighting means of a color or design in contrast to the coating material 24 indicia sections 12, 14 and 16, such that exposure of the base layer 22 is readily discernable. The highlighting means can therefore present a hidden code which may be changed periodically to prevent counterfeiting. The highlighting means can also be color coded, such that alterations in color would indicate a variation in rates or type of cards in use. Once the time zone has been set, in that the highlighted areas are exposed, the card can be mounted within the vehicle, or provided with a tab so that it may be hung by the window, according to the regulations provided by the local authorities.

Figure 3:
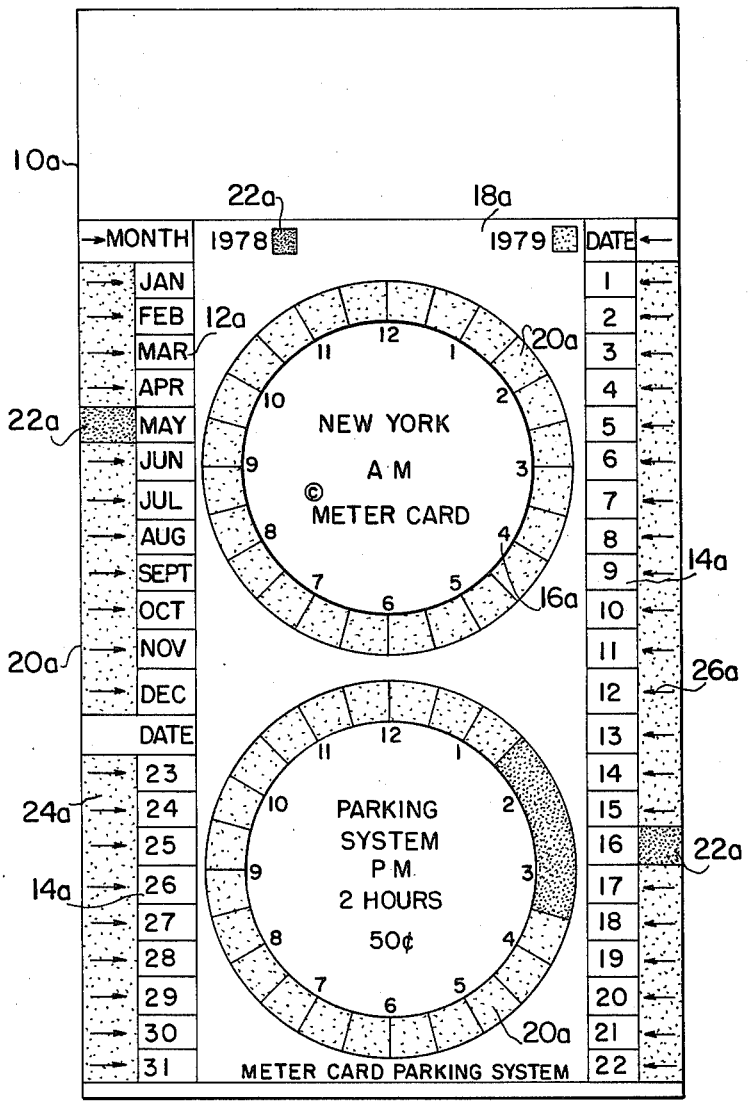
FIG. 3 is a front elevation view of the face of a vehicle parking ticket in accordance with another embodiment of the invention, also during use.

FIG. 3 shows an alternative embodiment of the invention wherein the vehicle packing ticket 10*a* has a varied time zone display indicia for the hours 16*a*. The illustration reveals an exposed base layer 22*a* and shows a time zone from 1:30 PM to 3:30 PM. on May 16, 1978, Any type of indicia layout using vertical, horizontal, circular, or related display manner is therefore possible.

Although the invention has been described relative to exemplary embodiments thereof, it will be understood that other variations and modifications can be effected in these embodiments without departing from the scope and spirit of the invention.

I claim:

1. A vehicle parking ticket comprising a card, a series of indicia indicating month printed on said card, first laminated card activating area means disposed adjacent each of said series of month indicating indicia, a series of indicia indicating day of the month printed on said card, a second laminated card activating area means disposed adjacent each of said series of day indicating indicia, a series of hour indicating indicia, a third laminated card activating area means disposed adjacent each of said series of hour indicating indicia, said first, second and third laminated card activating area means comprising a base layer containing the card face bearing indentification means printed thereon, a coating material superimposed on said base layer, said coating material adapted to be destroyed by abrasion and a design layer printed on said coating material, whereby the ticket is used by destroying the design layer and coating material through abrasion to exposed the base layer adjacent the month, date and hour indicia.

2. The ticket in claim 1 wherein the coating layer comprises a latex based metallic ink.

3. The ticket in claim 1 wherein the identification means comprises a colored face portion contrasting with the indicia sections.

4. The ticket in claim 1 wherein the design layer comprises indicating means for the indicia sections.

* * * * *